US010334917B2

(12) United States Patent
Hang et al.

(10) Patent No.: US 10,334,917 B2
(45) Date of Patent: Jul. 2, 2019

(54) PENDANT ADAPTER FOR INTERLOCKING BUILDING TOY

(71) Applicants: Leung Chu Hang, Hong Kong (HK); Lau Ching Yi, Hong Kong (HK)

(72) Inventors: Leung Chu Hang, Hong Kong (HK); Lau Ching Yi, Hong Kong (HK)

( * ) Notice: Subject to any disclaimer, the term of this patent is extended or adjusted under 35 U.S.C. 154(b) by 266 days.

(21) Appl. No.: 15/044,333

(22) Filed: Feb. 16, 2016

(65) Prior Publication Data

US 2016/0249713 A1 Sep. 1, 2016

Related U.S. Application Data

(60) Provisional application No. 62/126,459, filed on Feb. 28, 2015.

(51) Int. Cl.

| | |
|---|---|
| ***A44C 15/00*** | (2006.01) |
| ***A44C 25/00*** | (2006.01) |
| ***A44C 13/00*** | (2006.01) |
| ***A63H 33/08*** | (2006.01) |
| *A44B 15/00* | (2006.01) |

(52) U.S. Cl.

CPC ..... *A44C 13/00* (2013.01); *A44C 25/001* (2013.01); *A63H 33/086* (2013.01); *A44B 15/005* (2013.01)

(58) Field of Classification Search

CPC ..... A44C 13/00; A44C 15/003; A44C 25/00; A44C 25/001; A44C 25/007

USPC ..... 224/309.1, 310, 316.5, 316.7, 308, 300, 224/301, 324, 328, 339, 249, 268; 63/1.11, 1.12, 1.18, 12, 13, 18, 33

See application file for complete search history.

(56) References Cited

U.S. PATENT DOCUMENTS

| | | | | |
|---|---|---|---|---|
| 1,022,791 | A * | 4/1912 | Laird, Jr. | A45F 5/02 217/24 |
| 2,112,339 | A * | 3/1938 | Kasparek | A63B 57/0032 206/315.1 |
| 2,894,119 | A * | 7/1959 | Stenger | F21L 15/08 224/249 |
| 3,136,549 | A * | 6/1964 | Ruderian | A63F 5/04 224/246 |
| 4,827,575 | A * | 5/1989 | Delaney | A44C 17/00 24/3.2 |
| 6,213,839 | B1 * | 4/2001 | Pedersen | A63H 3/36 446/101 |
| 7,343,647 | B1 * | 3/2008 | Kinskey | A45F 5/00 16/406 |
| 7,458,488 | B2 * | 12/2008 | Bass | A45F 5/00 224/162 |
| 9,277,793 | B2 * | 3/2016 | Rana | A44C 17/0208 |
| 9,596,924 | B1 * | 3/2017 | Fully | A45F 5/00 |
| 2009/0078002 | A1 * | 3/2009 | Mpasiakos | A44C 25/007 63/1.11 |
| 2015/0082831 | A1 * | 3/2015 | Ellman | A44C 13/00 63/1.13 |

* cited by examiner

*Primary Examiner* — Jack W Lavinder

(57) ABSTRACT

A pendant adapter for interlocking building toy. Its unique shape can be easily assembled with the building toy's interlocking structure and requires no alteration to the toy. It enables user to connect the toy to a chain, a thread or other accessories, effectively transforming the toy into an apparel or ornamental item. Additionally, a foldable configuration may allow the adaptor to be adjustably fitted with an array of toy parts which vary in sizes and shapes.

8 Claims, 11 Drawing Sheets

PENDANT ADAPTER FOR INTERLOCKING BUILDING TOY

CROSS-REFERENCE TO RELATED APPLICATION

This application claims the priority of provisional application 62/126,459, of the same title, with the same specification and by the same inventors, filed Feb. 28, 2015.

BACKGROUND OF THE INVENTION

Interlocking building toy is a highly customisable toy of which different parts can be swapped and assembled via an interlocking system to create a huge number of combinations. With the popularity of such toys and their wide range of representations, there is an increasing demand for a way to create custom-made apparel items based on these toys.

There have been previous attempts at responding to this demand, with less-than-ideal results. Referring to FIG. 1A and 1B, a typical prior solution is illustrated. A screw eye 1 is installed into the toy 2 by forcibly drilling a hole 3 in it. Then the toy 2 can be connected with a diversity of accessories (such as a chain 4). Thus, a pendant is created. In another exemplary prior art shown in FIG. 2, adhesive 5 is applied to the toy 2's surface, binding a loop 6 on top of it which creates a similar result.

These methods are commonly used, yet both result in irreversible damages to the toy which is not favored by most toy collectors. The toy's integrity is compromised as both screwing and gluing effects cannot be completely undone. Also, these methods require professional techniques, which can only be practiced by skilled craftsmen.

This invention is an improved solution which overcomes the problems mentioned above. It is intended to be compatible with existing building toy pieces, so hereby incorporates certain popular building toy designs (U.S. Pat. No. 3,005,282 and D253,711) as reference. These toy designs are shown in dashed lines for illustrative purpose.

BRIEF SUMMARY OF THE INVENTION

This invention is an interchangeable adaptor to convert interlocking building toy into pendant with minimal effort. By utilising the interlocking structure of the building toy, portion of the adaptor can serve as a fastener to be assembled with the standardized parts of the toy, firmly securing the adapter and the toy together with no physical alteration required. It can be assembled and removed easily, so a single adaptor can be used on different toy pieces repeatedly.

There is an aperture on the adaptor which can be connected with other accessories, transforming the toy into different forms of adornments, such as necklace, brooch, earring, keychain, phone charm, hanging ornament, etc.

According to one embodiment of the present invention, the adaptor is preferably equipped with a foldable mechanism, which allows the adaptor to be adjustably fitted with a wider range of toy parts. Also, user may repeatedly convert the adaptor from a flat state to the required form, adding additional portability.

All illustrations are not intended to drawn to scale, and do not define the precise proportions of the invention and its elements.

DETAILED DESCRIPTION OF THE INVENTION

Herein various embodiments of the present invention will be described. Some features are very similar in many of the different embodiments. To avoid redundancy, detailed description of similar features may not be repeated in some circumstances. However, it should be understood that a formerly described feature can also be applied to other relevant embodiments.

Figure 1A:
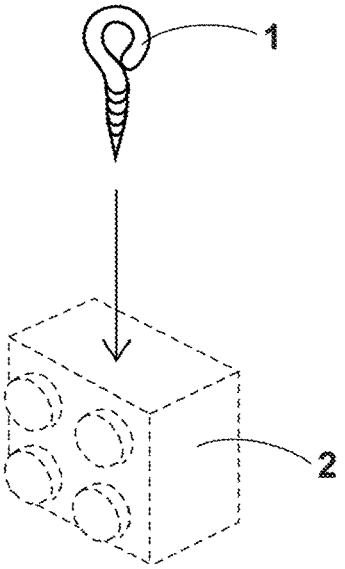
FIG. 1A (Prior Art)
FIG. 1A-1B illustrate a screw eye installed into a building toy piece according to a first prior art.
Figure 1B:
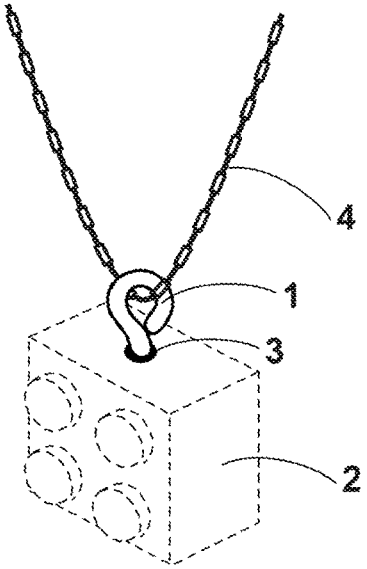
FIG. 1B (Prior Art)
Figure 2:
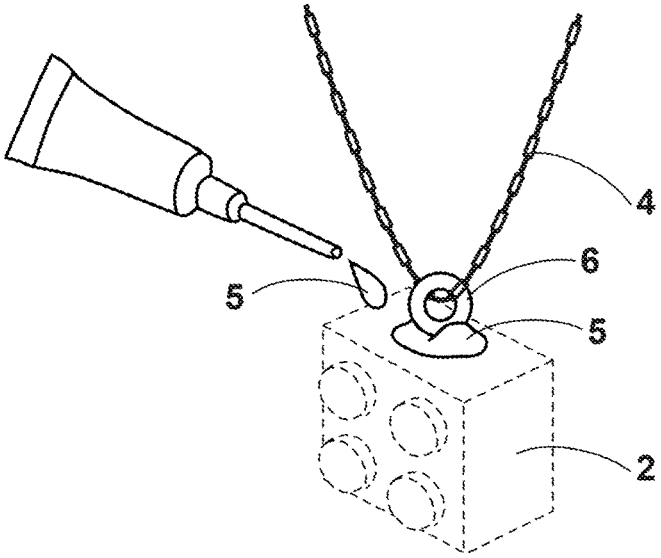
FIG. 2 (Prior Art)
FIG. 2 illustrates a loop glued on top of a building toy piece according to a second prior art.
Figure 3A:
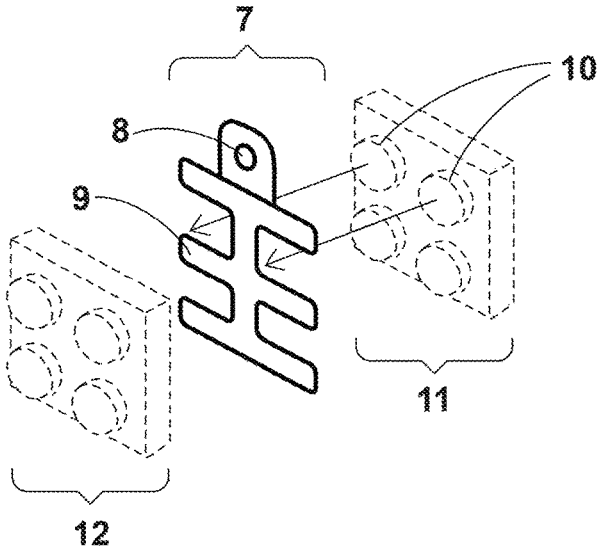
FIG. 3A-3B are perspective views of one embodiment of the adaptor according to the invention, showing how it fits between two building toy pieces.
Figure 3B:
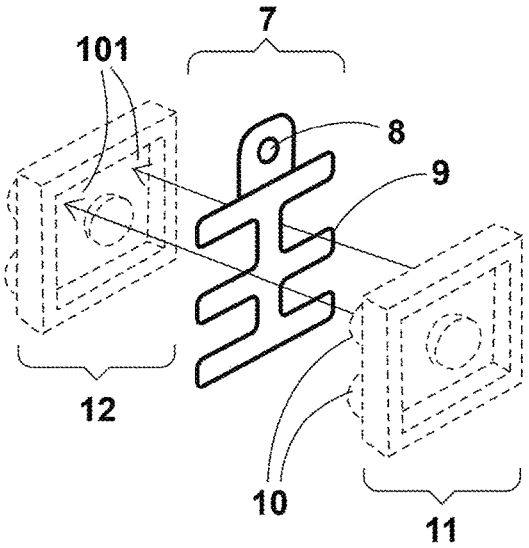
Figure 3C:
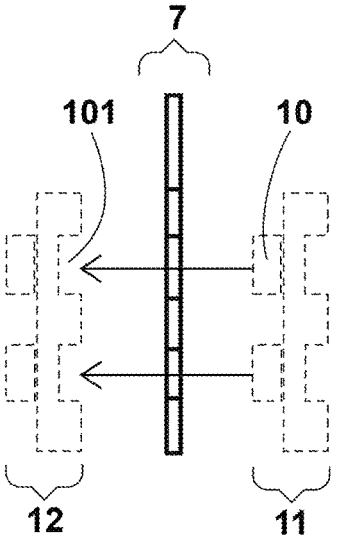
FIG. 3C is a side view of FIGS. 3A-3B.

According to one embodiment as illustrated in FIGS. 3A, 3B and 3C, the adaptor 7 is a piece of thin material, comprising an aperture 8 at the upper section which can be connected with a variety of accessories, and a lower section 9 that serves as a fastener to be assembled with the building toys. Typically, the building toys are interlocked together by small, cylindrical studs 10 on top of a toy block 11 which can be wedged into notch 101 at the back of another block 12.

Figure 4:
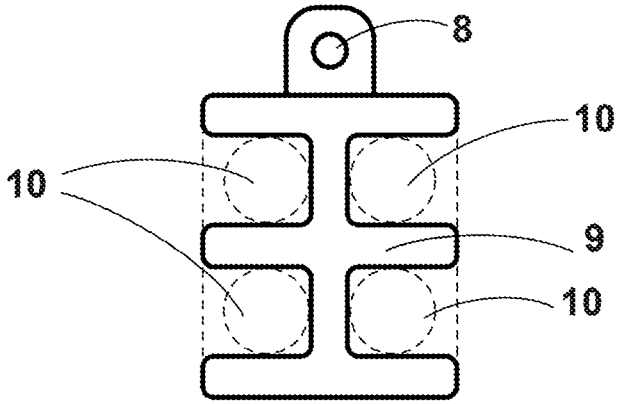
FIG. 4 is a front view of the adaptor of FIG. 3A-3B, further illustrates how it fits with the building toy's stud system.

The shape of the fastener 9 is tailor-made to be compatible with such stud system. It precisely fits into the vacancy between the studs 10 and hooks up with them as shown in the front view of FIG. 4 . Therefore, when the two building toy blocks 11 and 12 are interlocked together, the fastener 9 can be clamped in-between.

Figure 5:
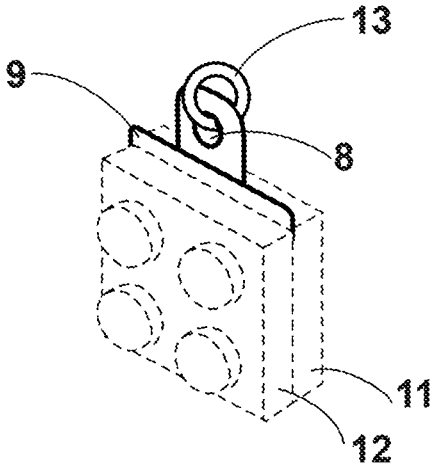
FIG. 5 is a perspective view of the adaptor and toy pieces of FIG. 3A-3B assembled and transformed into a pendant.
Figure 6A:
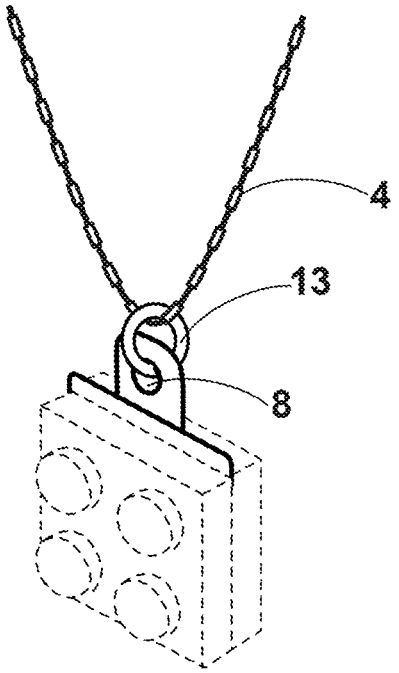
FIG. 6A shows the pendant of FIG. 5 serving as a necklace.
Figure 6B:
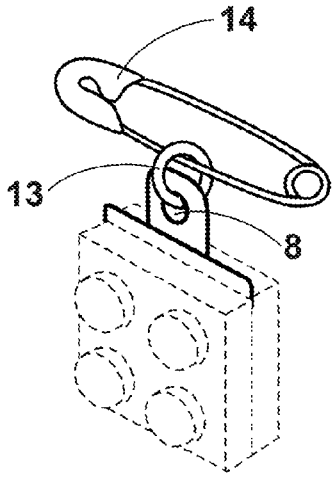
FIG. 6B shows the pendant of FIG. 5 serving as a brooch.
Figure 6C:
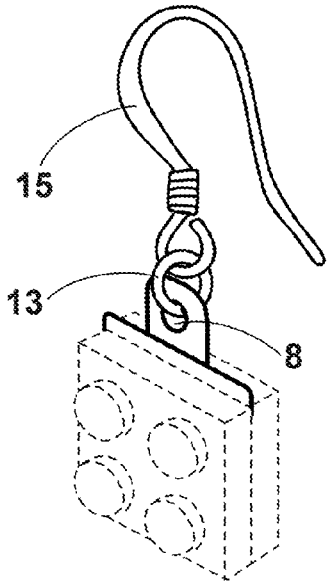
FIG. 6C shows the pendant of FIG. 5 serving as a earring.
Figure 6D:
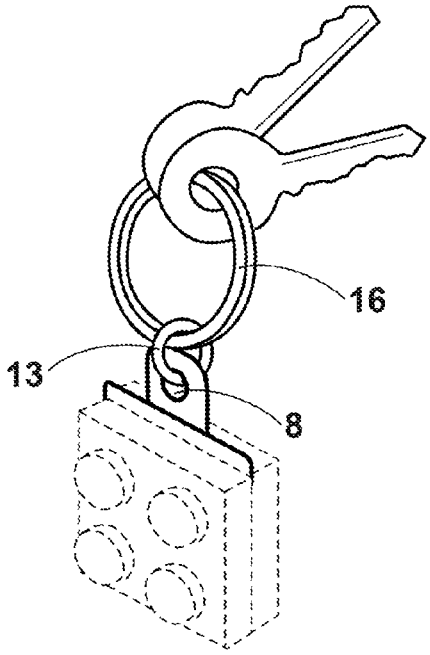
FIG. 6D shows the pendant of FIG. 5 serving as a keychain.
Figure 6E:
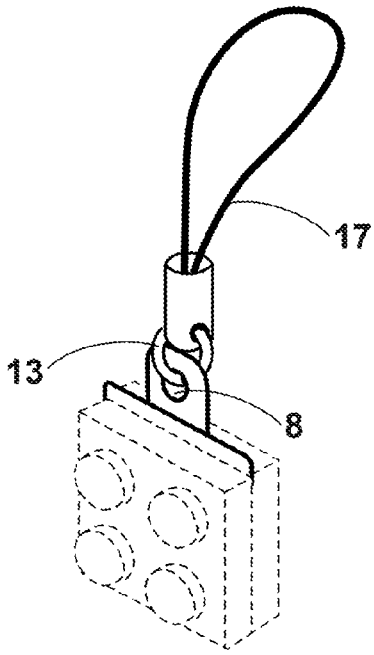
FIG. 6E shows the pendant of FIG. 5 serving as a phone charm.

FIG. 5 illustrates the adaptor assembled with the building toys blocks. The fastener 9 is preferably to be as thin as possible to be firmly clamped by the two toy blocks 11 and 12 without loosening them, as a result fixing the adaptor and the building toy together securely. By attaching a jump ring 13 to the aperture 8 at the protruding upper end of the adaptor, the building toys has become a loose-hanging piece of pendant.

This pendant may serves a variety of functions, including but not limited to the examples shown in FIGS. 6A, 6B, 6C, 6D and 6E in which the jump ring 13 is connected to a chain 4, a pin 14, an earring hook 15, a keyring 16, and a phone strap 17 respectively, thus transforming the building toy into a necklace, a brooch, an earring, a keychain and a phone charm respectively. It should be noted that the above examples are just a few common usages of the present invention, and should not be seen as an exhaustive list of all possible applications. Also, the jump ring 13 is an additional component which is not essential in some cases. Any accessories that can be directly attached to the aperture 8 should be applicable to the adaptor. Depending on the circumstances, actual usages of this invention can be varied.

Figure 7A:
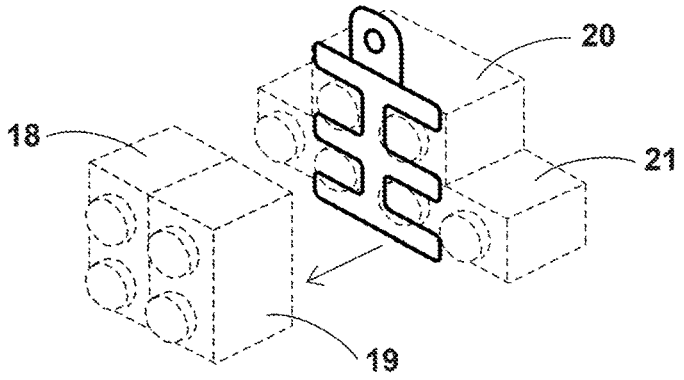
FIG. 7A-7C illustrate the adaptor of FIG. 3A-3B assembled with different toy pieces.
Figure 7B:
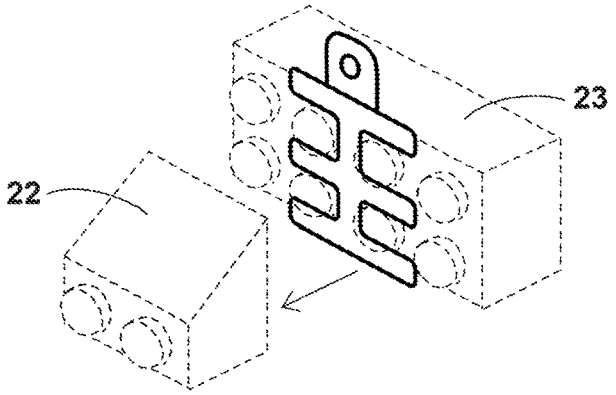
Figure 7C:
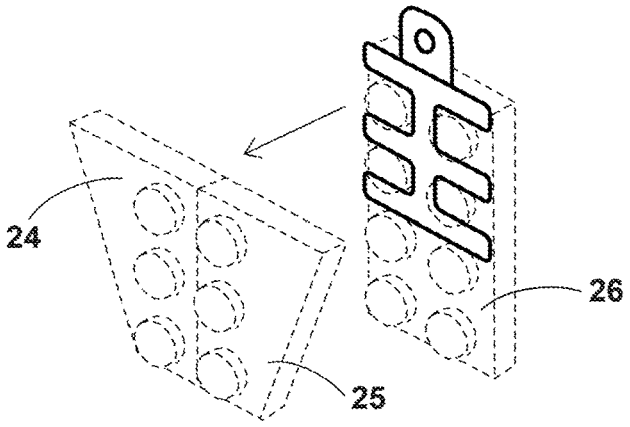

This invention offers tremendous flexibility, as the aforementioned assembly causes no physical damage and alteration to the toy, thus the transformation is non-permanent and reversible. The adapter can be removed from the toy easily, by simply taking the interlocked toy blocks apart. Therefore, as illustrated in FIG. 7A-7C, it is possible to reassemble the adaptor repeatedly on different toy blocks 18-26. Although only a few examples are shown, these illustrations suggest that despite the variations in size and shape, as long as the toy blocks comprise a standardized interlocking stud system, they should be able to fit with the adaptor effortlessly. As a result, it allows endless possibilities of customization.

Figure 8A:
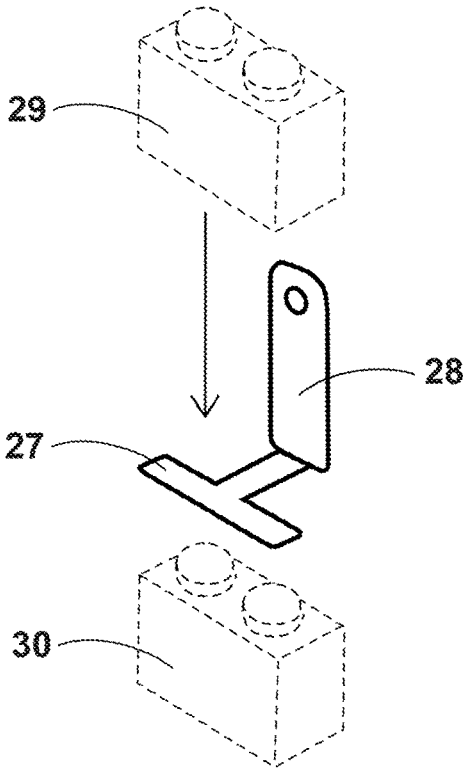
FIG. 8A is a perspective view of another alternative embodiment of the adaptor according to the invention, which is assembled with the toy pieces in a different direction.
Figure 8B:
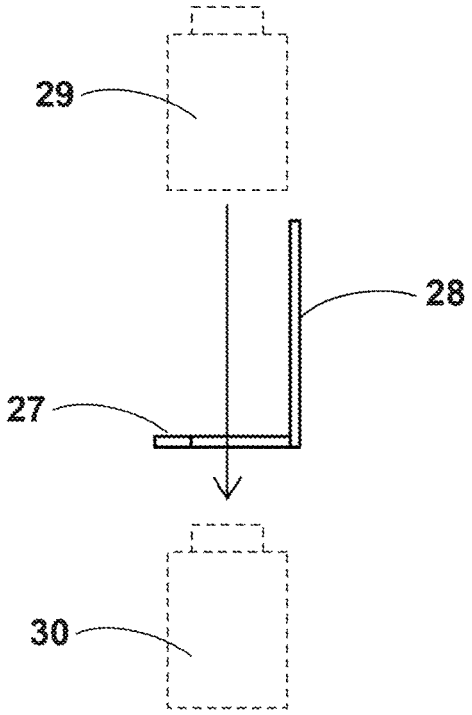
FIG. 8B is a side view of FIG. 8A.
Figure 9:
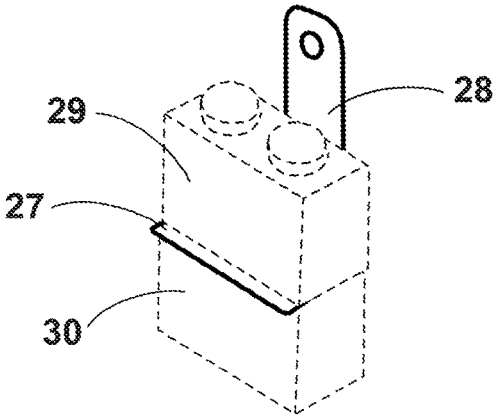
FIG. 9 is a perspective view of the adaptor and toy pieces of FIG. 8A-8B assembled and transformed into a pendant.

FIGS. 8A and 8B illustrate an alternative embodiment of the invention. The fastener 27 is protruded from the main body 28 and perpendicular to it. So when the fastener 27 is assembled with the building toy blocks 29 and 30, they will be in a standing position of which the studs are pointing upward rather than forward. The example of FIG. 9 illustrates how this configuration can create an alternatively looking pendant.

Figure 10:
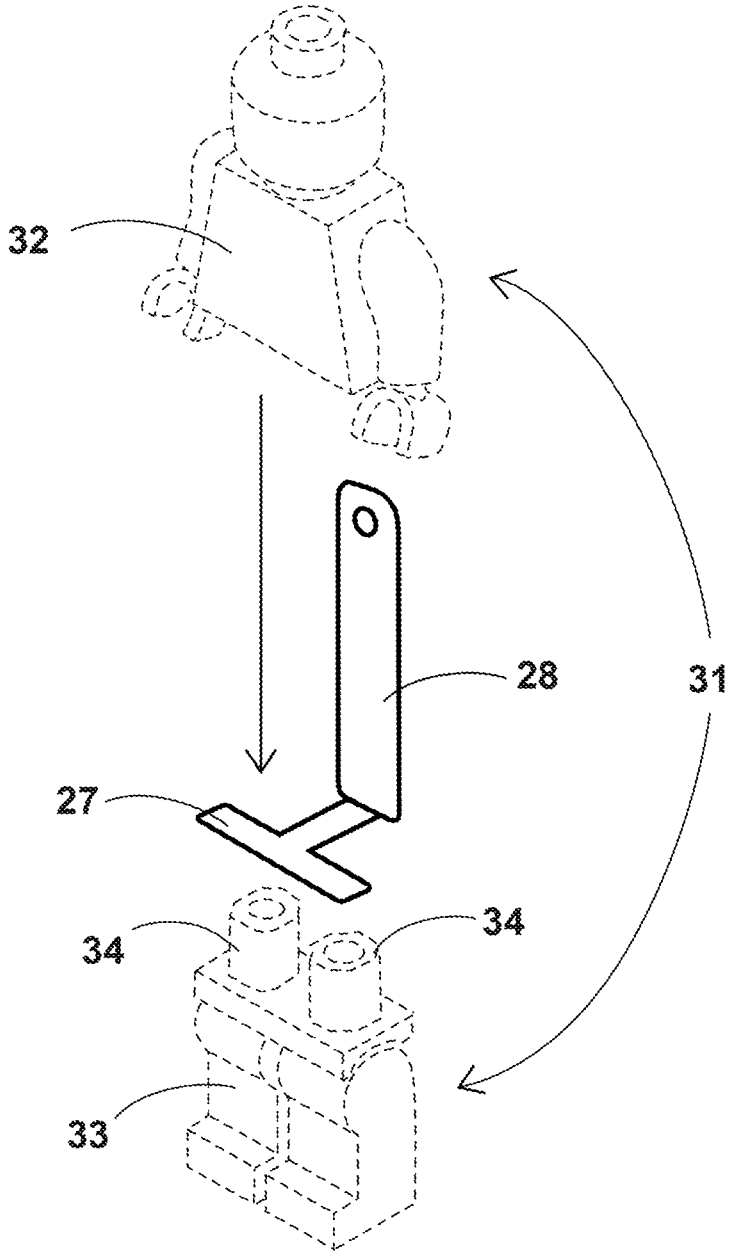
FIG. 10 is a perspective view of the adaptor of FIG. 8A-8B assembling with a building toy figure.
Figure 11:
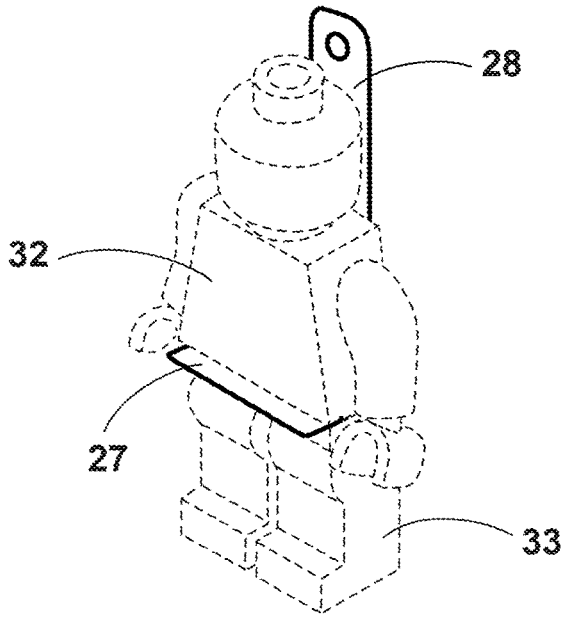
FIG. 11 is a perspective view of the adaptor and toy figure of FIG. 10 assembled and becomes a pendant.

Referring to FIG. 10, the aforementioned configuration is also compatible with a building toy FIG. 31, whose body parts are also interchangeable via an interlocking system consistent with the building toy blocks. The figure mainly comprises an upper body 32 and a lower body 33. The studs 34 on top of the lower body, though taller, share the same perimeter as a standard block's studs. Therefore, the fastener 27 can be hooked up to the studs 34 without difficulty. When the two body parts 32 and 33 are assembled, as shown in FIG. 11, the adaptor and the figure are securely fixed together.

Figure 12A:
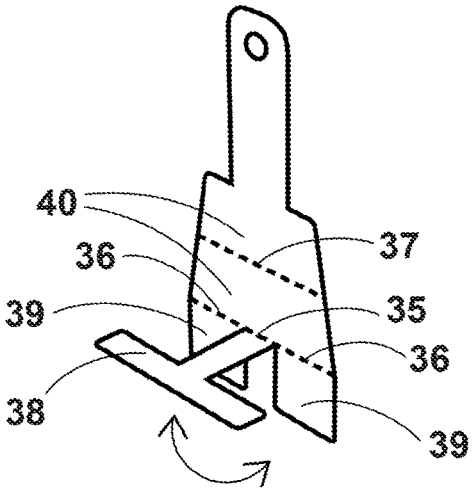
FIG. 12A-12B are perspective views of another alternative embodiment of the adaptor according to the invention which comprises foldable sections, illustrating one folding mechanism.
Figure 12B:
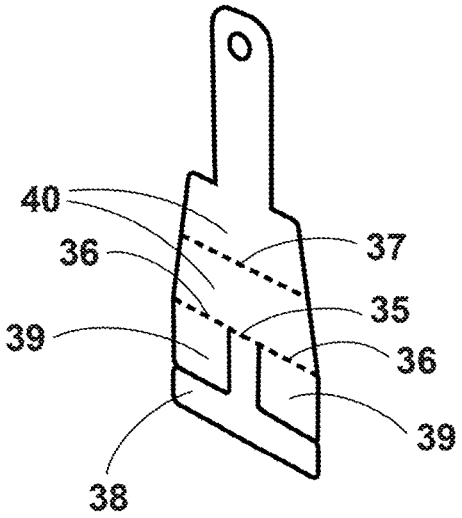

While this invention can be made of any rigid materials, in one embodiment, it is most effectively produced from a strong but bendable material, with segments that are weakened or scored to serve as fold lines 35, 36 and 37, as shown in FIGS. 12A and 12B. Firstly, this configuration allows the repeated bending of fold line 35, which convert the fastener 38 into a perpendicular position (FIG. 12A) and back to a flat state (FIG. 12B) when it is not in use. As a result, the adaptor can be easily placed inside any slim compartment, such as pocket, wallet or card holder. Since the fastener 38 is foldable without a fixed angle, the toy may have a tendency to lean forward. So there are two supporting tabs 39 at lower end of the adaptor shoving the toy to an upright position, which also contributes solidity and stability.

Figure 13A:
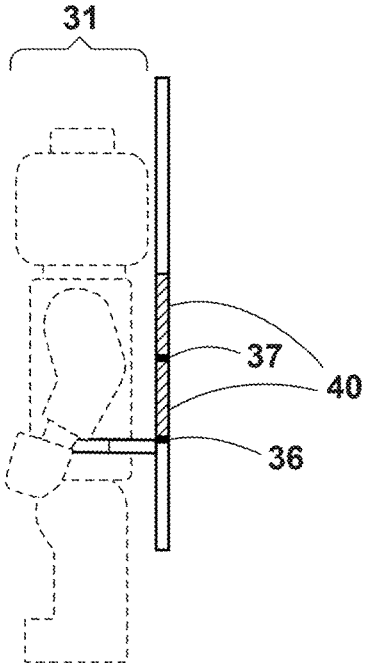
FIG. 13A-13B are side views of the adaptor of FIG. 12A-12B assembled with a toy figure, showing another folding mechanism.
Figure 13B:
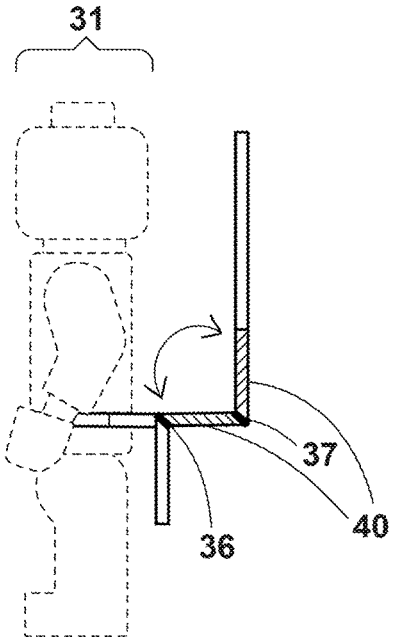

Furthermore, with extra fold lines 36 and 37 acting as adjustable hinges, the main body has become a flap 40 with adjustable forms. As further illustrated in the side views of FIGS. 13A and 13B, bending fold lines 36 and 37 results in different angles of the flap 40. For example, without adjusting the flap 40 as shown in FIG. 13A, the adaptor should press close to the FIG. 31, leaving very little space between them; while folding the flap 40 into a 90-degree angle as shown in FIG. 13B results in a large gap between the two units. Adjusting the flap 40 in various angles gives results between these two extremes, providing relatively more or less space between the two units.

Figure 14A:
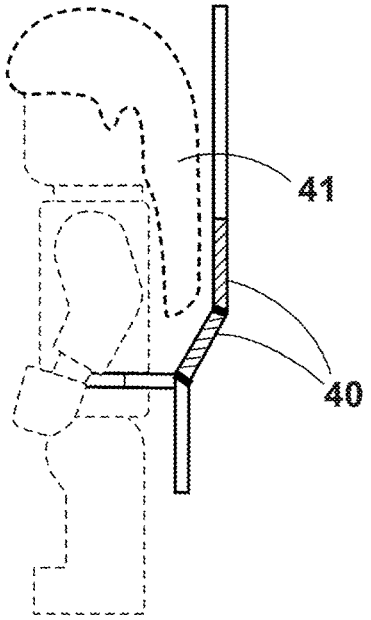
FIG. 14A-14C illustrate how the folding mechanism of FIG. 13A-13B adjustably fits with different toy figure parts.
Figure 14B:
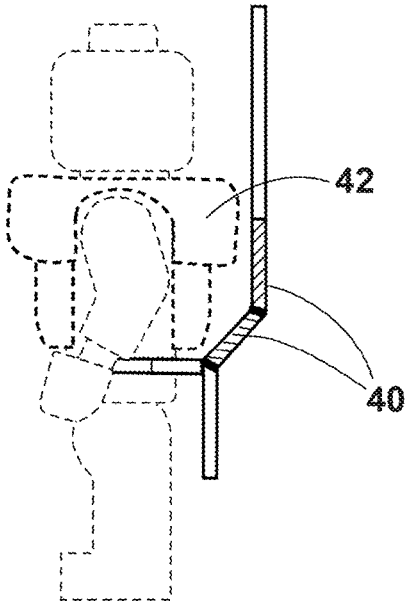
Figure 14C:
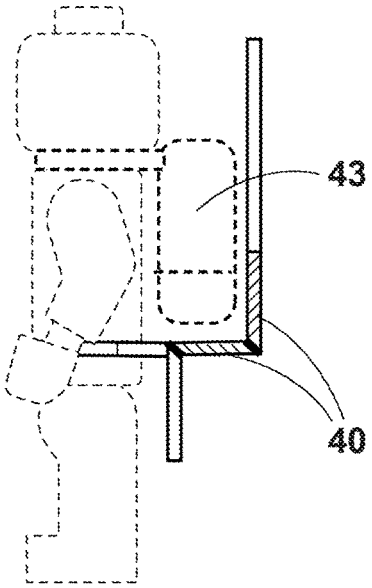

This foldable mechanism is preferable for the adaptor to be adjustably fitted with a diversity of toy figure parts which come in a huge variation of sizes and shapes. For example, FIG. 14A shows a piece of long wig 41 which extends to the back of the figure's body. To allow the adaptor to fit with the long wig 41, user may slightly adjust the flap 40's angle to expand a little gap between the two units which gives room for the long wig 41. Two more examples are shown in FIGS. 14B and 14C, in which an armour 42 and a backpack 43 occupy even larger space behind the figure. By further adjusting the flap 40 into different optimal angles respectively, the adaptor can accommodate these two parts as well.

Although only three examples are shown above, the aforementioned explanation suggests that the adjustable flap 40 can be compatible with a wide variety of toy figure parts. Also, while the drawings show only two sets of fold lines 36 and 37, the actual number used in practice can be varied.

Figure 15:
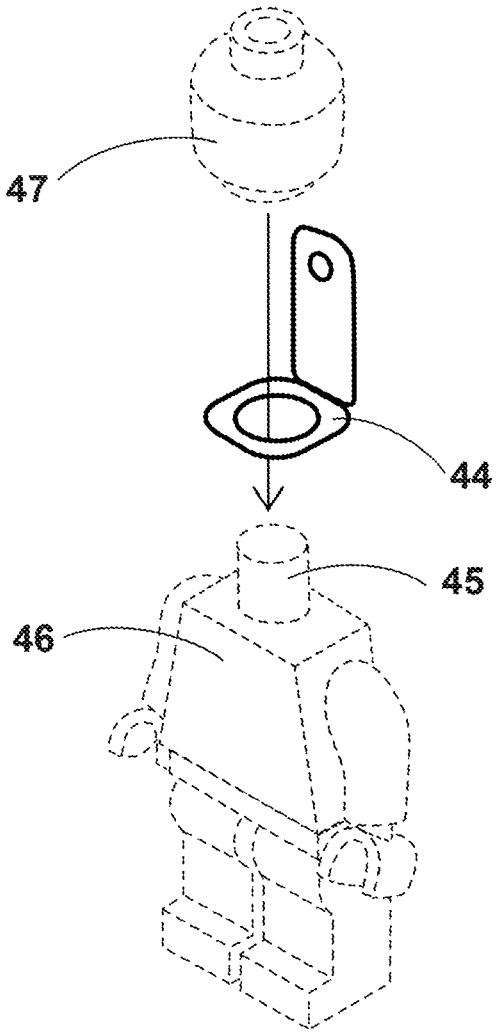
FIG. 15 is a perspective view of another alternative embodiment of the adaptor according to the invention, which is assembled between the head and torso of the toy figure.

Another alternative embodiment of the invention is illustrated in FIG. 15. Because a building toy figure comprises various interlocking sections in different body parts, this invention could also be practiced with varying configurations. For example, in FIG. 15, a circular fastener 44 is attached on a single stud 45 on top of the figure's torso 46 and clamped by the head 47.

This invention is thus an innovative adaptor which effortlessly converts interlocking building toys into pendants for a diversity of functions. The described embodiments are presented for the purpose of explanation, and not intended to limit this invention or any of its components to any preferred embodiments. For instance, although only certain toy designs are used as illustrative examples of this invention, it should be understood that the same concept can also be applied to other toy designs with similar interlocking mechanisms. Any potential alternatives, modifications and variations as can be included within the spirit and scope of the foregoing descriptions should be covered by this invention.

We claim:

1. A multi-functional pendant including a plurality of interlocking toy pieces and an interchangeable adaptor for converting said plurality of interlocking toy pieces into said multi-functional pendant, each said interlocking toy piece comprises at least one protruding stud on one side and at least one depression notch on a different side of said interlocking toy piece, said at least one protruding stud of each one of said interlocking toy pieces is removably engageable, by an interference fit, with said at least one depression notch on any other of said interlocking toy pieces; and, said interchangeable adaptor comprises at least one fastener shaped to fit into a space defined around said at least one protruding stud, said at least one fastener is made of a piece of material sufficiently thinner than a thickness of said at least one protruding stud for enabling said at least one fastener to be firmly clamped between at least two of said interlocking toy pieces when the at least one protruding stud has been engaged, by an interference fit, with said at least one depression notch; and, wherein said interchangeable adaptor further comprises at least one aperture for connecting the multi-functional pendant to a variety of accessories.

2. The adaptor according to claim 1, which is made of a single piece of material.

3. The adaptor according to claim 2, wherein said material is flexible enough so that it can be bent easily and repeatedly without substantial tearing.

4. The adaptor according to claim 1, further comprising a bendable section made of a piece of a material flexible enough so that it can be bent easily and repeatedly without substantial tearing, said fastener is a part of said bendable section and comprises at least one scored fold line on the surface, for enabling said fastener to be more easily folded up and down, whereby improving portability.

5. The adaptor according to claim 1, further comprising a bendable section made of a piece of a material flexible enough so that it can be bent easily and repeatedly without substantial tearing, said bendable section comprises a plurality of scored fold lines on the surface, to allow easier folding for creating an adjustable space between said adaptor and said toy pieces, for enabling said adaptor to accommodate a wider range of said toy pieces in different sizes and shapes.

6. The adaptor according to claim 1, wherein said fastener comprises means for folding up and down easily and repeatedly without substantial tearing.

7. The adaptor according to claim 1, comprises means for creating an adjustable space between said adaptor and said toy pieces, for enabling said adaptor to accommodate a wider range of said toy pieces in different sizes and shapes.

8. A method for making a multi-functional pendant for a variety of accessories, comprising a. providing a plurality of interlocking toy pieces, each said interlocking toy piece comprises at least one protruding stud on one side and at least one depression notch on a different side of said interlocking toy piece, said at least one protruding stud of each one of said interlocking toy pieces is removably engageable, by an interference fit, with said at least one depression notch on any other of said interlocking toy pieces;

b. providing an interchangeable adaptor for converting said plurality of interlocking toy pieces into said multi-functional pendant, said interchangeable adaptor comprises at least one fastener shaped to fit into a space defined around said at least one protruding stud, said at least one fastener is made of a piece of material sufficiently thinner than a thickness of said at least one protruding stud; and, c. clamping said at least one fastener between at least two interlocking toy pieces into said space defined around said at least one protruding stud by engaging said at least one protruding stud with said at least one depression notch, by an interference fit; and, wherein said interchangeable adaptor further comprises at least one aperture for connecting the multi-functional pendant to a variety of accessories.

* * * * *